US005983990A

United States Patent [19]

Alvarez

[11] Patent Number: 5,983,990

[45] Date of Patent: Nov. 16, 1999

[54] MACHINE FOR WARMING AND SPRAYING PAINT OR VISCOUS FLUIDS

[76] Inventor: Kenneth Alvarez, 19910 W. 95th St. S., Clearwater, Kans. 67026

[21] Appl. No.: 08/740,655

[22] Filed: Oct. 31, 1996

[51] Int. Cl.[6] ..... F25B 29/00

[52] U.S. Cl. ..... 165/48.1; 165/47; 237/12.3 R; 148/600

[58] Field of Search ..... 165/43, 48.1, 42, 165/47; 237/12.3 R; 417/388; 148/600

[56] References Cited

U.S. PATENT DOCUMENTS

| | | | |
|---|---|---|---|
| 4,196,854 | 4/1980 | Prucyk | 237/12.3 R |
| 4,575,003 | 3/1986 | Linker et al. | 237/12.3 R |
| 4,576,122 | 3/1986 | Marcato | 237/12.3 R |
| 4,723,892 | 2/1988 | Cowan | 417/222 |
| 5,785,760 | 7/1998 | Sconyers et al. | 165/42 |

*Primary Examiner*—James C. Yeung
*Assistant Examiner*—Terrell McKinnon
*Attorney, Agent, or Firm*—Kenneth Jack

[57] ABSTRACT

A machine for warming and spraying paint comprising a water cooled internal combustion engine, a pump for pumping the paint, a power transfer means linking the engine drive linkage to the pump drive linkage, a heat exchange chamber having an interior channel therethrough enabling heated liquid coolant and paint introduced into the heat exchange chamber to flow therethrough and exchange heat without commingling of the two fluids, a liquid coolant transfer means for carrying the liquid coolant in a circuit path including the internal combustion engine radiator, the internal combustion engine, and the heat exchange chamber, and a paint transfer means allowing paint to travel through an open ended path including the pump and the heat exchange chamber, the paint transfer means allowing the paint to be pumped by the internal combustion engine and the pump and to be simultaneously warmed by heat transferred from the liquid coolant to the paint within the heat exchange chamber.

9 Claims, 6 Drawing Sheets

MACHINE FOR WARMING AND SPRAYING PAINT OR VISCOUS FLUIDS

FIELD OF THE INVENTION

This invention relates to paint spraying apparatus having means for heating the paint to be sprayed prior to application of the paint.

BACKGROUND OF THE INVENTION

The advantages of heating paint prior to spray application of the paint are well known. Heated enamel based paint typically applies more smoothly and evenly, and dries more swiftly when heated prior to application. Heated enamel based paint also is more easily atomized by a paint spraying gun, with reduced clogging effect. Thus, it is economical and efficient to provide a paint spraying machine which is capable of heating paint prior to spray application.

Methods of providing a paint spraying machine capable of heating paint prior to application are known. One example of such an apparatus provides an electric paint heater attached to the framework of the paint spraying machine. Disadvantages of such apparatus include lack of availability of electricity at remote work sites.

Another known method of supplying heat to paint prior to application by a paint spraying machine is to utilize the exhaust system or the engine coolant system of a vehicle or a separate piece of internal combustion engine driven equipment to warm the paint. In such applications, heat from the engine's coolant or exhaust system is diverted by tubes to a paint warmer. Such systems and applications are unwieldy and cumbersome because they require use of a vehicle or other apparatus in conjunction with the paint spraying machine.

The instant invention solves the deficiencies of prior known methods and machines for application of heat to paint prior to application by providing a paint spraying machine driven and powered by a water cooled internal combustion engine, the engine supplying the motive force for spraying and supplying heat to the paint. Such a configuration has several advantages in economy and use over the prior art.

PRIOR ART PATENTS

U.S. Pat. No. 4,196,854 issued Apr. 8, 1980, to Martin D. Prucyk discloses a truck-mounted paint spraying machine, the exhaust system of the truck supplying heat to the paint prior to application. Prucyk does not teach the novel, unique and inventive aspects of the present invention.

SUMMARY OF THE INVENTION

A rectangular metal framework is provided, the framework having a pair of wheels rotatably mounted at opposing lower edges of the framework; providing for portability of the machine. Fixedly mounted within the metal framework is a water cooled internal combustion engine of the type having a radiator, and a water jacket defining a space surrounding the cylinders of the engine for circulation of engine coolant. A hydraulic pump is fixedly mounted within the framework, the drive linkage of the hydraulic pump being fixedly attached to and in alignment with the drive linkage of the internal combustion engine. The hydraulic pump draws hydraulic fluid from a hydraulic oil reservoir also fixedly mounted upon the metal framework. The hydraulic pump supplies hydraulic oil pressure and fluid flow to a two-way reciprocating hydraulic ram. The hydraulic ram is fixedly mounted upon the framework, supplying a reciprocating driving force to a reciprocating high pressure paint pump.

Fixedly attached within the metal framework is a cylindrical heat exchange chamber. The paint pump draws paint out of a paint reservoir, and drives the paint into the heat exchange chamber. Upon entering the heat exchange chamber, the paint travels through a stainless steel coil tube within the heat exchange chamber, and then exits the heat exchange chamber to travel through a paint line to a spray gun.

The radiator hose which would normally extend from the water jacket outlet port of the internal combustion engine to the inlet port of the radiator is diverted to extend from the water jacket outlet port to an inlet port entering the heat exchange chamber. There, heated engine coolant flows over the stainless steel tubular coil containing paint to be heated, resulting in heat transfer and warming of the paint without commingling of the two fluids. The engine coolant exits the heat exchange chamber through an engine coolant outlet port to flow through tubing to return to the engine radiator inlet port. This configuration as described allows the internal combustion engine to perform the dual functions of driving the paint to be sprayed and heating the paint to be sprayed.

It is an object of the present invention to provide a paint spraying machine whose motor performs the dual functions of driving the paint to be sprayed, and heating the paint to be sprayed.

It is a further object of the present invention to provide a paint spraying machine which is capable of spraying paint and of heating paint without utilization of a separate heating apparatus.

It is a further object of the present invention to provide a paint spraying machine capable of spraying paint and heating paint without the requirement of an outside source of heat or power to either drive the paint or heat the paint.

It is a further object of the present invention to provide a paint spraying machine which is capable of both spraying and heating paint which is both portable, compact, and economical to use.

Other objects and advantages of the present invention will be more apparent after a reading of the following detailed description taken in conjunction with the drawings provided.

DETAILED DESCRIPTION OF THE PREFERRED EMBODIMENT

Figure 1:
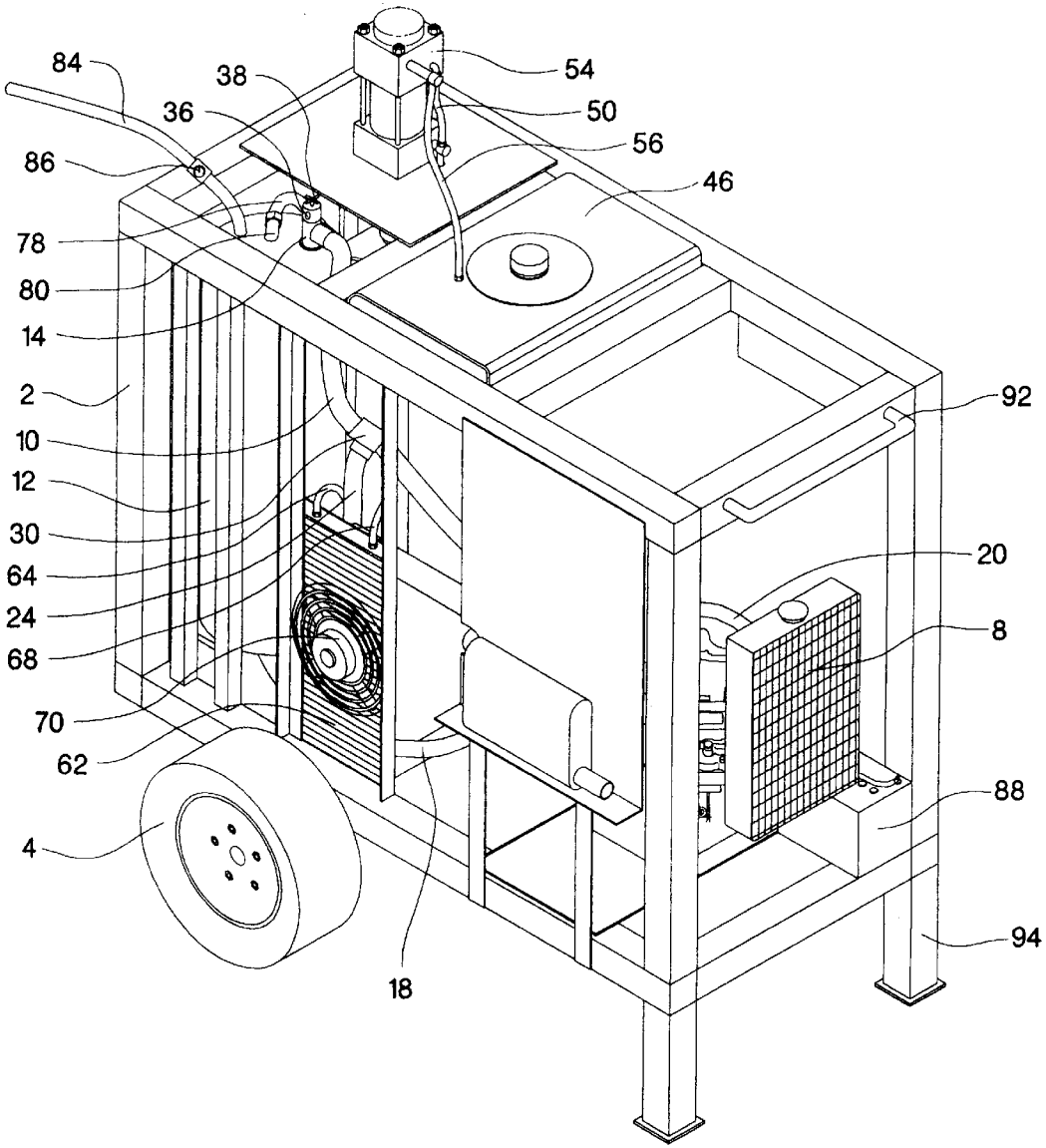
FIG. 1 is an isometric view of the paint spraying machine.

Referring to FIG. 1, a rectangular steel framework 2 composed of square steel tubing is provided, a pair of wheels being fixedly and rotatably mounted at opposing sides of the lower structural members of the steel framework 2.

Figure 2:
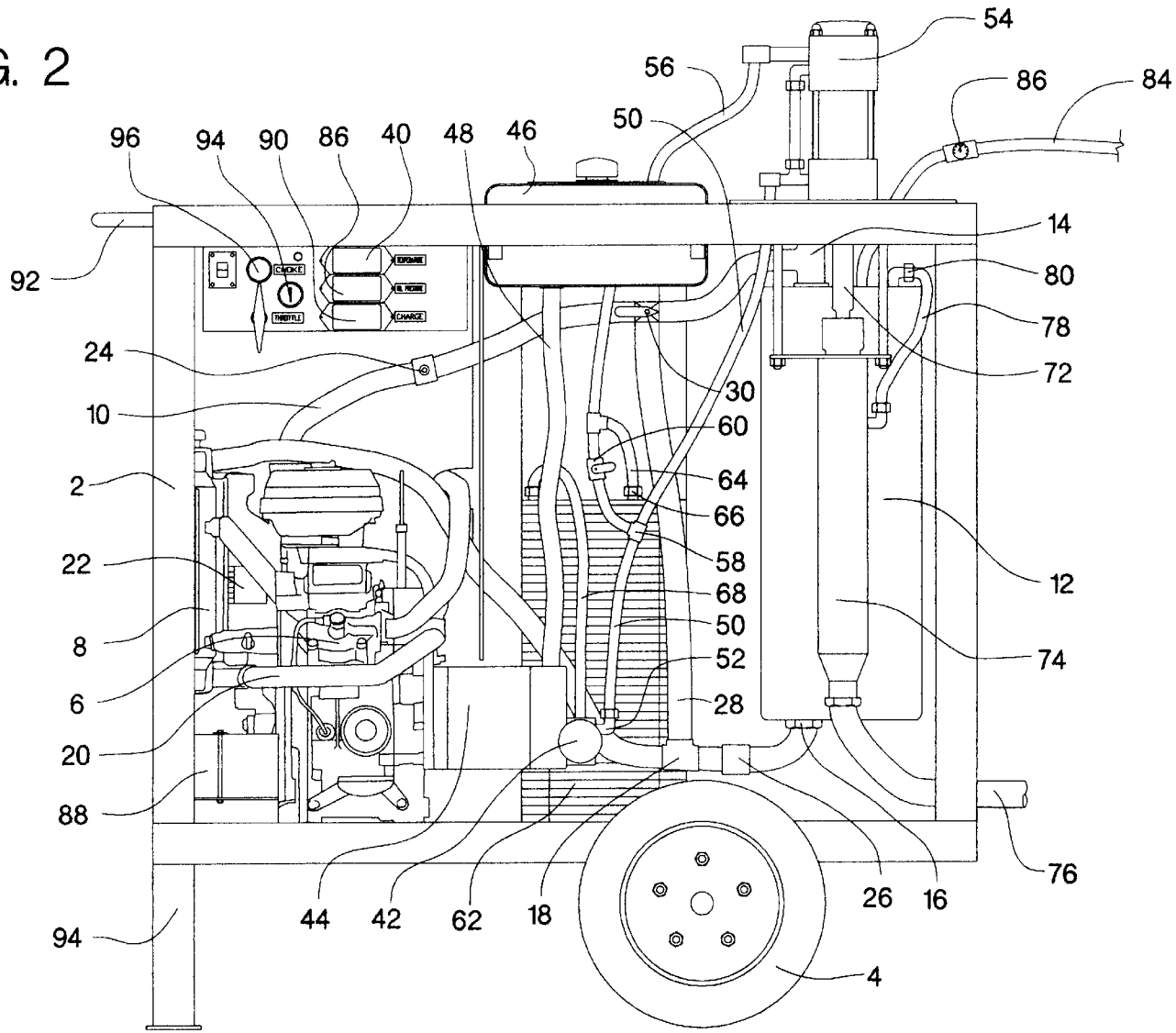
FIG. 2 is a view from the side of the paint spraying machine.

Referring to FIG. 2, a two cylinder overhead valve internal combustion engine is fixedly mounted within the framework; and referring to FIG. 1, the engine being water cooled by means of a radiator 8. Referring again to FIG. 2, heated engine coolant flows out of the water jacket of the internal combustion engine 6 to flow through an engine coolant output tube 10. Heated engine coolant flows through the engine coolant output tube 10 away from the internal combustion engine 6 and toward a heat exchange chamber 12. Referring to FIG. 1, the engine coolant output tube 10 is fixedly attached to a heat exchanger coolant inlet port 14. The engine coolant flows through the heat exchanger coolant inlet port 14 and, referring to FIG. 2, through the heat exchange chamber 12 to exit from a heat exchanger coolant outlet port 16. The engine coolant then flows along an engine coolant return tube 18 to return to the radiator 8. The coolant flows through the radiator 8 and exits therefrom to flow through a water jacket return tube 20 to flow into the water jacket of the engine 6 for purposes of cooling.

Figure 8:
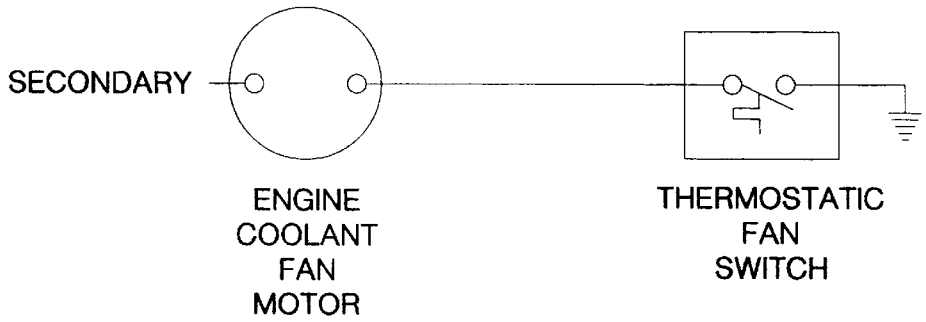
FIG. 8 is a representational electrical schematic of thermostatic control applicable to the radiator fan of the paint spraying machine.

The radiator 8 is cooled by an electric radiator fan 22, the fan being controlled by a temperature sending switch 24 mounted upon the engine coolant output tube 10. The temperature sensing switch 24 preferably is of a type causing an electric circuit to be closed, actuating the fan 22, when the temperature of the engine coolant within the engine coolant output tube 10 reaches 200°, and opens the circuit, shutting off the fan 22, when the coolant drops to 185° Fahrenheit. Such thermostatic control of the radiator fan 22 provides consistent heat of 185° Fahrenheit to 200° Fahrenheit to the heat exchange chamber 12. Referring simultaneously to FIGS. 2 and 8, the temperature sensing switch 24 switch acts as a simple circuit breaker cutting off electrical power to the radiator fan motor 22 upon reaching the prescribed temperature.

Referring again to FIG. 2, a one way check valve 26 is installed inline with the engine coolant return tube 18 preventing backward flow of engine coolant along the engine coolant return tube 18 toward the heat exchange chamber 12.

Referring further to FIG. 2, an engine coolant bypass tube 28 provides a shunt between the engine coolant output tube 10 and the engine coolant return tube 18. A three way valve 30 may be manually positioned to direct the flow of engine coolant from the engine coolant output tube 10 toward either the heat exchange chamber 12 or to the engine coolant bypass tube 28. When the three way valve 30 is set to direct flow of the engine coolant along the engine coolant bypass tube 28, the one way check valve 26 checks the back flow of engine coolant into the heat exchange chamber 12, allowing the engine coolant to return to the radiator along the engine coolant return tube 18 without passing through the heat exchange chamber 12.

Figure 3:
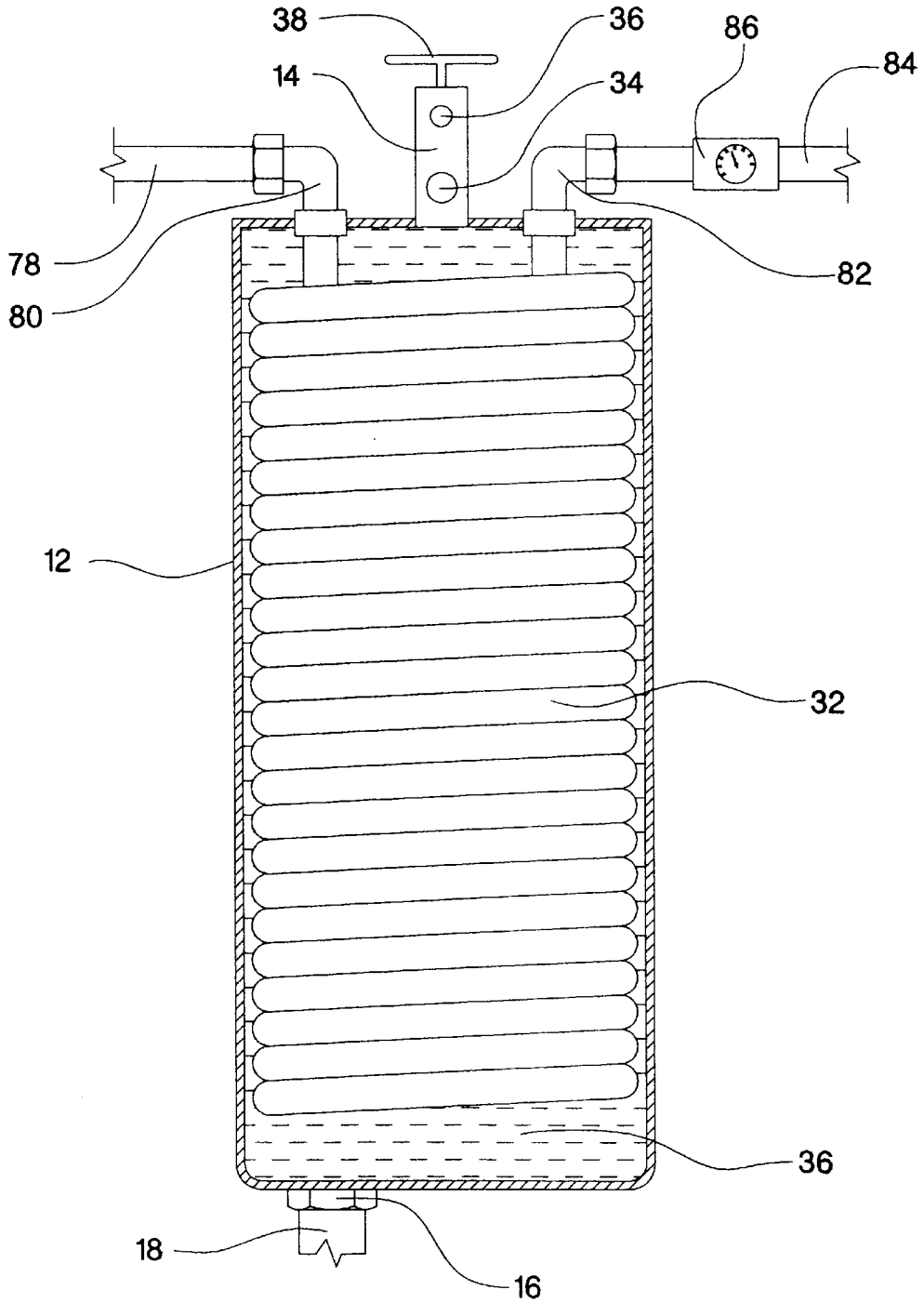
FIG. 3 is a cutaway view of the heat exchange chamber of the paint spraying machine.

Referring to FIG. 3, the heat exchange chamber 12 is a cylindrical vessel preferably composed of stainless steel, containing a stainless steel heat exchanging coiled tube. The heat exchanger coolant inlet port 14 has an aperture 34 to which, referring to FIG. 2, the terminal end of the engine coolant outlet tube 10 is attached. Referring to FIG. 3, engine coolant 36 flows through the aperture 34 and into the interior space of the heat exchange chamber 12, flowing over the heat exchange coil 32 to exit from the heat exchanger coolant outlet port 16. Referring to FIGS. 1 and 3, the heat exchanger coolant inlet port 14 has a site glass 36 allowing a machine operator to view the interior of the heat exchanger coolant inlet port 14 to see whether it is filled with air or coolant. An air bleed off valve 38 is provided at the top of the heat exchanger coolant inlet port 14 to release any air accumulated at the top of the heat exchange chamber 12.

Figure 6:
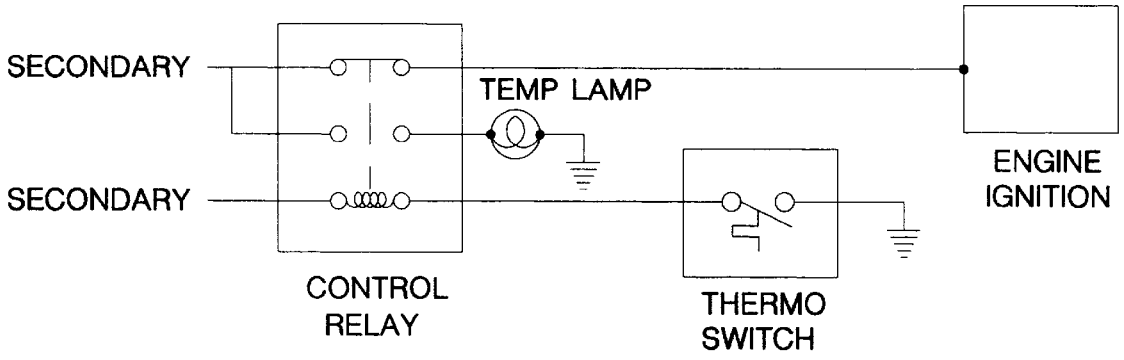
FIG. 6 is a representational electrical schematic of a thermal cutoff function of the paint spraying machine.

Referring simultaneously to FIG. 2 and FIG. 6, a second temperature sending switch is mounted on the engine water jacket providing an ignition cutoff when the temperature of engine coolant within the water jacket reaches 225° Fahrenheit. Upon cooling of the engine coolant to 222° Fahrenheit, the temperature sending switch reopens allowing the engine 6 to be restarted, and turns off the temperature light 40.

Referring to FIG. 2, a hydraulic pump 42 is mounted upon the engine drive housing 44, the drive linkage of the hydraulic pump 42 being fixedly attached to the drive linkage of the engine 6. The hydraulic pump preferably provides 1,300 lbs. per square inch of pressure at 10.2 gallons per minute of flow. A hydraulic oil reservoir 46 is fixedly attached to the upper frame of the machine with a hydraulic oil supply line 48 extending downward from the reservoir 46 to supply hydraulic oil to the hydraulic pump 42. A hydraulic output line 40 is fixedly attached to the output port 52 of the hydraulic pump 42, and extending upward to supply hydraulic pressure and flow to the dual terminals of a two way reciprocating hydraulic ram 54. After providing driving force to the hydraulic ram 54, the hydraulic oil exits therefrom to return to the hydraulic oil reservoir 46 through a hydraulic oil return line 56.

Referring further to FIG. 2, a hydraulic bypass line 58 extends from the hydraulic output line 50 to the hydraulic oil reservoir 46, the hydraulic bypass line 58 having a cutoff valve 60 installed inline. When the cutoff valve 60 is closed, hydraulic pressure and flow is provided to the hydraulic ram 54, allowing the ram to operate. When the cutoff value 60 is opened, pressure ceases to be supplied to the hydraulic ram 54, and hydraulic oil flows from the hydraulic pump 42 to the hydraulic oil reservoir 46.

Referring simultaneously to FIGS. 1 and 2, a hydraulic oil radiator 62 is mounted within the metal framework. An oil radiator supply line 64 extends from the hydraulic bypass line 58 to the input port 66 of the radiator 62 providing a passageway for the flow of hydraulic oil from the hydraulic oil reservoir 46 to the radiator 62. An oil radiator output line 68 extends from the radiator 62 supplying additional oil to the low pressure side of the hydraulic pump 42. Referring to FIG. 1, the hydraulic oil radiator 62 is cooled by an electric radiator fan 70.

Referring to FIG. 2, upon application of hydraulic pressure and flow to the reciprocating two way hydraulic ram 34 through the hydraulic output line 50, the ram provides successive pulling and pushing forces to a pump shaft 72 which drives a reciprocating high pressure paint pump 74, the paint pump being fixedly mounted to the upper members of the steel framework 2. Upon successive driving and pulling of the pump shaft 72, the paint pump 74 draws paint or other viscous fluid to be sprayed from a fluid source such as a paint drum into and through a paint supply line 76. The paint or viscous fluid emits from the pump 74 at high pressure through a pump output line 78 to enter the heat exchange chamber 12 through a heat exchanger paint inlet port 80. Referring to FIG. 3, the paint or viscous fluid flows from the inlet port 80 through the heat exchanging coil 32 to emit from the heat exchange chamber 12 through a heat exchanger paint outlet port 82, and thence into a paint sprayer line 84. While the paint or other viscous fluid flows through the heat exchange coil 32, its temperature is raised to approximately 150° Fahrenheit. A thermometer 86 is affixed to the paint supply line 84 for easy determination of the temperature of the paint or other viscous fluid being sprayed.

Figure 5:
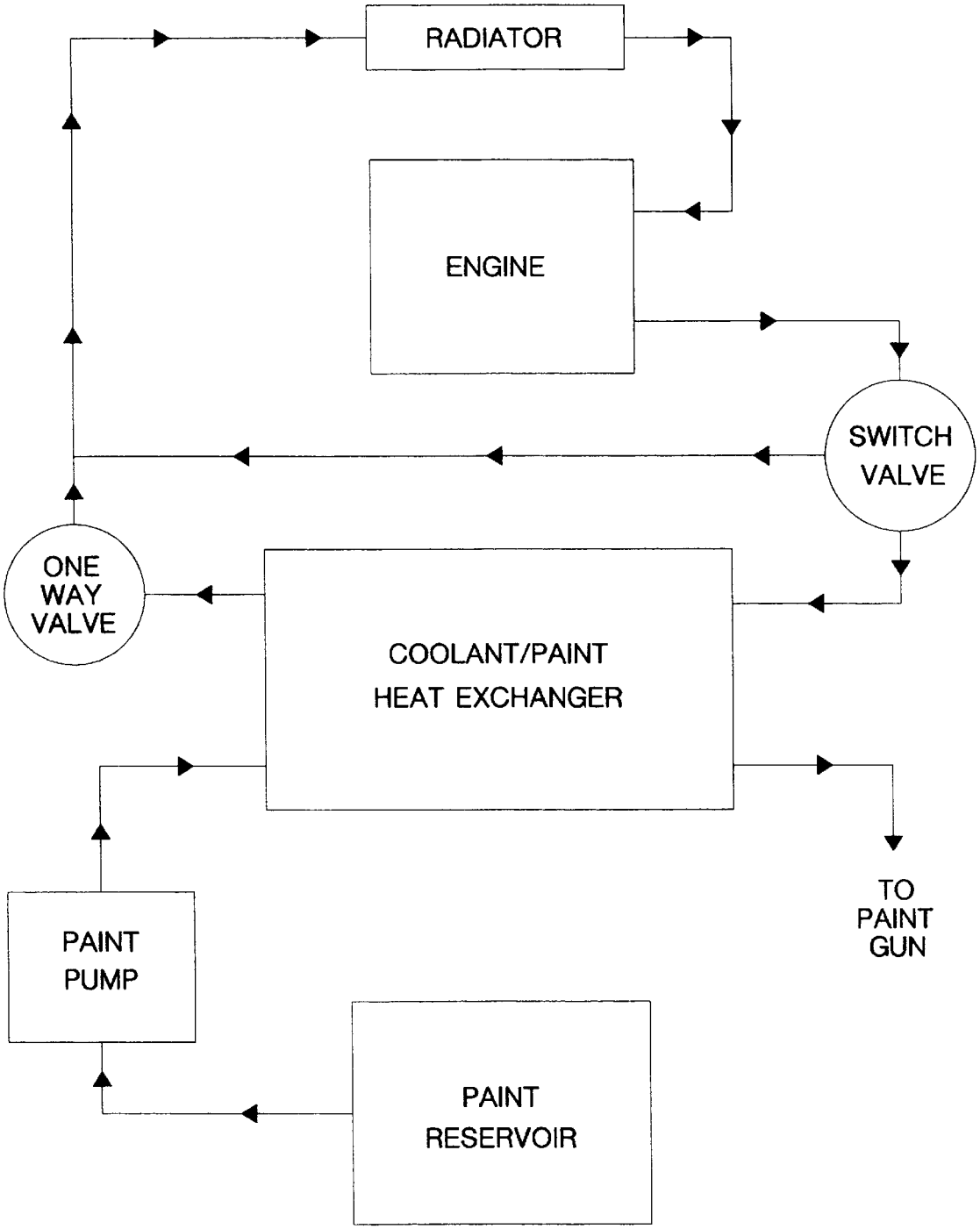
FIG. 5 is a representational flow chart portraying the flow of engine coolant and paint within the paint spraying machine.

In operation, referring to the flowchart, FIG. 5, engine coolant flows in a closed circuit from the engine radiator to the engine and thence alternately either to the heat exchanger or to the radiator depending on the setting of the switch valve. The paint or other viscous fluid to be sprayed flows in an open ended path from the paint reservoir to the paint pump to the heat exchanger to the paint gun.

Figure 7:
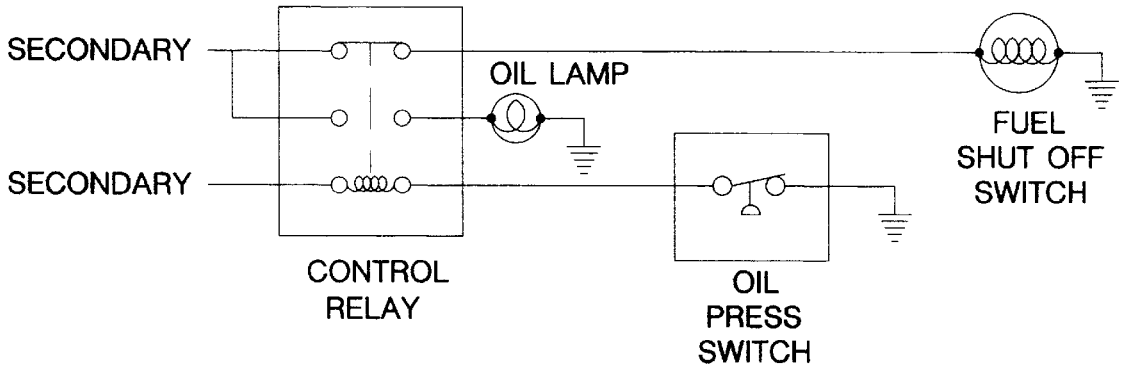
FIG. 7 is a representational electrical schematic of an oil pressure actuated cutoff function of the paint spraying machine.

Referring to FIG. 2, an oil pressure light 86 is provided, acting in conjunction with an oil pressure sending switch attached to the engine crank case, the oil pressure sending switch is selected so that it closes in the event oil pressure drops below 5 lbs. per square inch, and referring to FIG. 7, actuates a fuel shutoff switch and actuating the oil pressure light 86.

Referring to FIG. 2, the engine 6 operates on a twelve volt electrical system utilizing a twelve volt battery 88, and is provided with a charge failure light 90 which is actuated upon failure of the engine's alternator to provide adequate charge.

Figure 4:
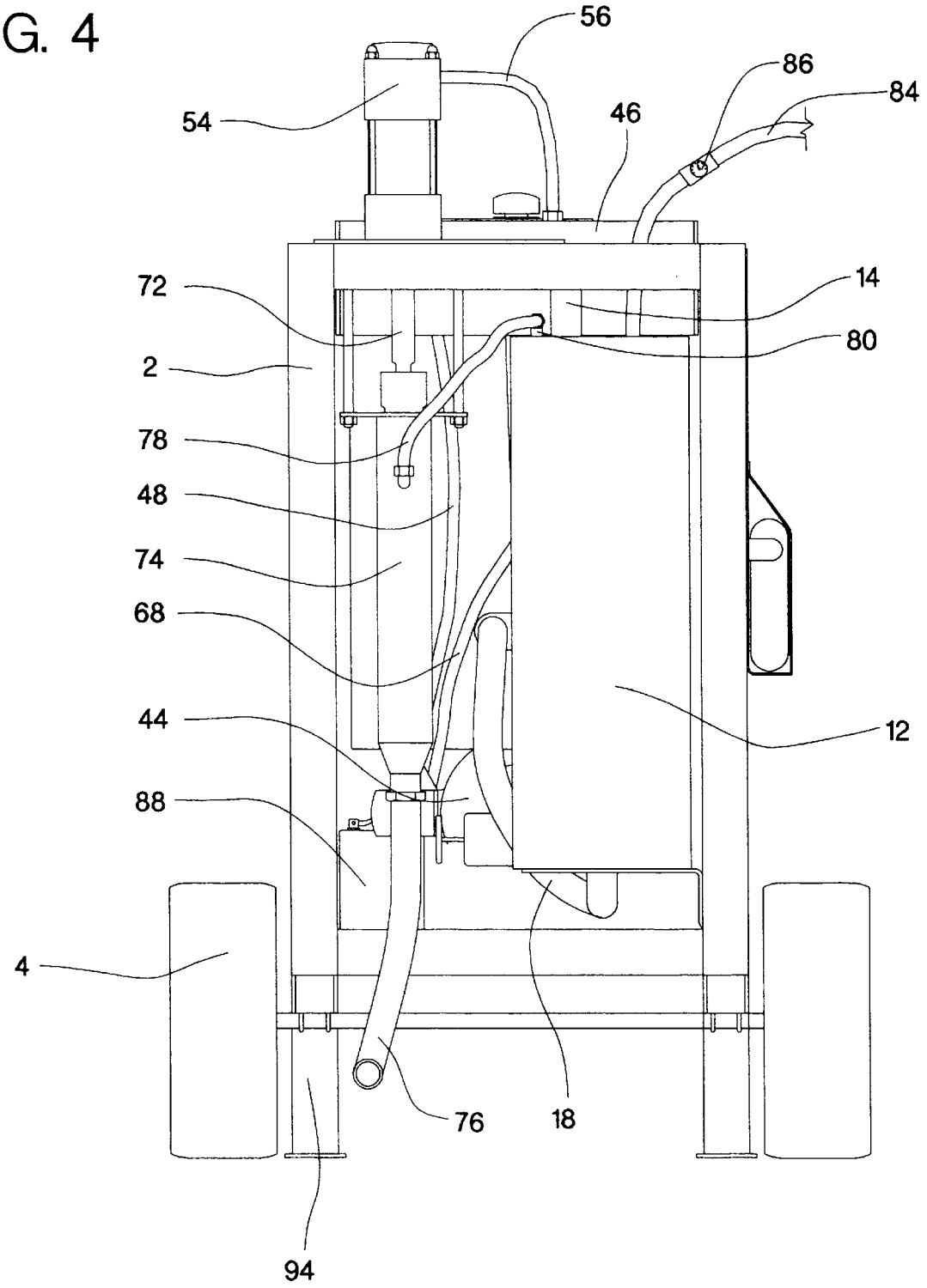
FIG. 4 is a rearview of the paint spraying machine.

In operation, referring to FIG. 1, the front end of the paint spraying machine may be raised by lifting a handle 92 causing support legs 94 to raise off of the ground allowing the machine to be rolled upon its wheels 4 to a desired position. Upon reaching the desired position, referring to FIG. 4, the paint supply line 76 is placed into a source of paint such as a paint barrel, the three way valve 30 is positioned to open the engine coolant bypass tube 30. The cutoff valve 60 is then opened, preventing hydraulic oil from flowing to the hydraulic ram 84 through the hydraulic output line 50. The engine 6 is then started utilizing the key ignition 94 and the choke button 96. After the engine 6 is started, the engine coolant will reach approximately 175° Fahrenheit in approximately fifteen minutes. At that time the three way valve 30 is turned to cause engine coolant to flow from the engine coolant output tube 10 into the heat exchanger coolant inlet port 14 and thence into the heat exchange chamber 12, to exit the heat exchange chamber through the heat exchanger coolant outlet port 16, then to return to the engine through the engine coolant return tube 18.

Referring to FIG. 1, upon establishment of flow of engine coolant through the heat exchanger 12, the operator looks through the site glass 36 of the heat exchanger coolant inlet port 14 to see if air is present in the system. If air is present, the air bleed off valve 38 is turned counter clockwise allowing the air to escape. Any air is bled off in order to assure flow of coolant through the heat exchange chamber. The air bleed off valve 38 is closed when coolant begins to seep from the valve.

Referring again to FIG. 2, after bleeding any air off of the heat exchange chamber, a paint spray gun is attached to the terminal end of the paint spray line 84, and the paint spraying machine is ready for use. In order to actuate the paint spraying and heating function of the apparatus, the cutoff valve 60 is closed, directing hydraulic pressure and flow to the hydraulic ram 54, causing the reciprocating high pressure paint pump 74 to begin to pump paint out of the reservoir and through the paint supply line 76. Referring to FIG. 3, the paint flows through the heat exchange coil 32 and is heated to approximately 160° at the point of exit through the heat exchanger paint outlet port 82. Upon opening of the trigger valve of a paint spray gun attached to the terminal end of the paint spray line 84, continuous flow of paint through the heat exchange coil 32 is established, resulting in continuous heating of the paint.

As many changes can be made in the preferred embodiments without departing from the scope of the invention or appended claims, it is intended that all matter contained in the description of the preferred embodiment be interpreted as illustrative of the invention, and not in a limiting sense.

I claim:

1. A machine for warming and spraying paint or viscous fluids comprising:

(A) An internal combustion engine, the internal combustion engine having a cooling system comprising liquid coolant, a liquid coolant radiator having a radiator inlet port and a radiator outlet port, and an engine water jacket having a water jacket inlet port and a water jacket outlet port, the internal combustion engine further having an engine drive linkage;

(B) A pump for pumping the paint or viscous fluid, the pump having a pump inlet port, a pump outlet port, and the pump having a pump drive linkage;

(C) A power transfer means linking the engine drive linkage to the pump drive linkage so that torque applied by the internal combustion engine to the engine drive linkage applies in sequence a driving force to the power transfer means and to the pump drive linkage;

(D) A heat exchange chamber, the heat exchange chamber having a heat exchanger coolant inlet port, a heat exchanger coolant outlet port, heat exchanger paint inlet port, and a heat exchanger paint outlet port; the heat exchange chamber further having an interior channel fixedly attached thereto within its interior space, the interior channel enabling heated liquid coolant introduced into the heat exchange chamber and paint or viscous fluid introduced into the heat exchange chamber to flow therethrough between their respective inlet and outlet ports for heat transfer between the two fluids without commingling of the two fluids;

(E) Liquid coolant transfer means fixedly attached to the radiator outlet port, the water jacket inlet port, the water jacket outlet port, the heat exchanger coolant inlet port, and fixedly attached to the heat exchanger coolant outlet port, the liquid coolant transfer means being capable of carrying the liquid coolant through a closed circuit including the liquid coolant radiator, the engine water jacket and the heat exchange chamber, allowing the liquid coolant warmed by the internal combustion engine within the engine water jacket to be transferred to the heat exchange chamber; and (F) Paint or viscous fluid transfer means fixedly attached to the pump inlet port, the pump outlet port, the heat exchanger paint inlet port, and fixedly attached to the heat exchanger paint outlet port, the paint or viscous fluid transfer means being capable of carrying paint or viscous fluid through an open mended path including in a series, the pump and the heat exchange chamber, the paint or viscous fluid transfer means allowing the paint or viscous fluid to be pumped by torque applied by the internal combustion engine in sequence to the power transfer means, and to the pump, and to be simultaneously warmed by heat transferred from the liquid coolant to the paint or viscous fluid within the heat exchange chamber.

2. The machine of claim No. 1 wherein the power transfer means comprises a hydraulic pump driven by the internal combustion engine, and a reciprocating hydraulic ram hydraulically linked to and capable of being powered by the hydraulic pump, and wherein the pump has a reciprocating piston having a piston shaft, the piston shaft being capable of being driven by the reciprocating hydraulic ram.

3. The machine of claim No. 2 further comprising a hydraulic fluid cooling radiator and a network of hydraulic tubing capable of diverting a portion of the hydraulic fluid driven by the hydraulic pump into and through the hydraulic fluid cooling radiator.

4. The machine of claim No. 3 wherein the interior channel of the heat exchange chamber comprises a coiled tube having a first end and a second end, the first end of the coiled tube being fixedly attached to the heat exchanger paint inlet port so that the interior bore of the coiled tube is continuous with the opening of the heat exchanger paint inlet port, and the second end of the coiled tube being fixedly attached to the heat exchanger paint outlet port so that the interior bore of the coiled tube is also continuous with the opening of the heat exchanger paint outlet port.

5. The machine of claim No. 4 wherein the liquid coolant transfer means comprises a plurality of coolant transfer tubes the ends thereof being fixedly attached to the radiator outlet port, the water jacket inlet port, the water jacket outlet port, the heat exchange coolant inlet port, the heat exchanger coolant outlet port and the radiator inlet port, the coolant transfer tubes interlinking the liquid coolant radiator, the heat exchange chamber, and the engine water jacket and comprising the closed circuit.

6. The machine of claim No. 5 wherein the paint or viscous fluid transfer means comprises a plurality of paint or viscous fluid transfer tubes, the ends thereof being fixedly attached to the pump inlet port, the pump outlet port, the heat exchanger paint inlet port, and the heat exchanger paint outlet port, the paint or viscous fluid transfer tubes interlinking the pump and the heat exchange chamber, and comprising the open ended path.

7. The machine of claim No. 5. Wherein the liquid coolant radiator comprises an electric radiator fan for cooling liquid coolant within the liquid coolant radiator; the paint spraying machine further comprising a thermally actuated electric circuit breaker mounted upon the coolant transfer tube extending from the engine water jacket to the heat exchange chamber, and a network of electrically conductive wiring electrically connecting the electric radiator fan to the thermally actuated electric circuit breaker, the thermally actuated electric circuit breaker controlling the electric radiator fan so that said fan remains off while the liquid coolant remains cool and so that the electric radiator fan drives air through the liquid coolant radiator while the liquid coolant remains relatively warm.

8. The machine of claim No. 7 wherein a plurality of components including the internal combustion engine, the liquid coolant radiator, the heat exchange chamber, the reciprocating piston pump, the reciprocating hydraulic ram, the hydraulic pump and the hydraulic fluid cooling radiator are fixedly mounted within a support frame.

9. The machine of claim No. 8 further comprising a pair of wheels fixedly and rotatably mounted upon opposing sides of the lower edge of the support frame, allowing the machine to be portably rolled from place to place.

* * * * *